US005327748A

United States Patent [19]

Izumi et al.

[11] Patent Number: 5,327,748

[45] Date of Patent: Jul. 12, 1994

[54] KNITTING NEEDLE FOR KNITTING MACHINE

[75] Inventors: Toshiro Izumi; Shunji Takeuchi, both of Hyogo, Japan

[73] Assignee: Precision Fukuhara Works, Ltd., Hyogo, Japan

[21] Appl. No.: 125,616

[22] Filed: Sep. 23, 1993

Related U.S. Application Data

[63] Continuation of Ser. No. 835,738, Feb. 13, 1992, abandoned.

[30] Foreign Application Priority Data

Feb. 18, 1991 [JP] Japan ..... 3-045962

[51] Int. Cl.[5] ..... D04B 35/02

[52] U.S. Cl. ..... 66/121; 66/123

[58] Field of Search ..... 66/121, 123, 124, 120, 66/116

[56] References Cited

U.S. PATENT DOCUMENTS

| | | | |
|---|---|---|---|
| 3,050,968 | 8/1962 | Masujima | 66/121 |
| 3,712,083 | 1/1973 | Slof et al. | 66/123 |
| 3,748,875 | 7/1973 | Slof et al. | 66/123 |
| 3,783,647 | 1/1974 | Torrant et al. | 66/123 |

FOREIGN PATENT DOCUMENTS

| | | | |
|---|---|---|---|
| 1115879 | 10/1961 | Fed. Rep. of Germany | 66/120 |

OTHER PUBLICATIONS

*Needle Characteristics*-Joseph Speetjens The Hosiery Trade Journal Mar. 1968, pp. 117-120.

Groz-Beckert Needles of High Precision-No date Published while W. Germany in existance.

*Primary Examiner*—Clifford D. Crowder

*Assistant Examiner*—John J. Calvert

*Attorney, Agent, or Firm*—Bell, Seltzer, Park & Gibson

[57] ABSTRACT

A knitting needle for use in knitting machines. The needle includes a shaft and a butt extending from the shaft for being received within a cam track of a knitting machine. The butt has a pair of substantially parallel side faces aligned with the needle shaft and upper and lower edges extending between the side faces. A medial face extends along a medial portion of each upper and lower edge of the needle butt between the side faces. A pair of angled faces extends between each medial face and side face to interconnect the medial face and side faces. The angled faces have an inclination angle approximately equal to the maximum inclination angle of the cam of the knitting machine in which the knitting needle is used. Each medial face may be arcuate in shape and the angled faces may be tangent to each associated arcuate face. Alternatively, the medial faces may be substantially planar and substantially perpendicular to the side faces of the butt.

14 Claims, 2 Drawing Sheets

KNITTING NEEDLE FOR KNITTING MACHINE

This application is a continuation of application Ser. No. 07/835,739, filed Feb. 13, 1992, now abandoned.

FIELD OF THE INVENTION

The present invention relates to knitting needles for use in knitting machines. In particular, the invention relates to a knitting needle having a butt that may be reciprocated by a cam in the knitting machine.

BACKGROUND OF THE INVENTION

Knitting machines often employ a plurality of knitting needles that are moved reciprocally in concert with one another to form a knitted fabric. Often, the knitting needles are reciprocated by a cam which defines an undulating track which urges the knitting needle to and fro. For example, many circular knitting machines have a cam which defines a recessed slot, or track. The needles used with such slotted cams have a longitudinal shaft from which a protrusion known as the butt of the needle extends. This butt of the knitting needle is received within the recessed cam track. The cam track generally defines an undulating path which the needle butt must follow as the butt is moved relative to the cam in a direction transverse to the longitudinal axis of the needle. Thus, the undulating sides of the cam track engage the needle butt and cause the knitting needle to move in a reciprocating fashion.

To increase efficiency and productivity, it is often desirable to maximize the speed at which the knitting machine may be operated. However, it has been found that increasing the operating speed of the knitting machine can impose severe stresses and increased wear on the knitting needles. As machine speed increases, the speed of reciprocation of the knitting needles installed in the machine likewise increases, and the cycle time for a complete reciprocation of each needle decreases.

As a result of the increasing machine speed, the initial force which is generated when the needle butt impacts the edge of the cam track is also greater than in machines operating at slower speeds. This impact and the forces associated with sliding of the needle butt within the cam track may cause increased wear of the needle butt. The impact may also cause the needle to vibrate. These vibrations may be transmitted from the butt to the shaft of the needle, and further, along the shaft of the needle to the hook at the end of the needle. Because the hook of the needle is relatively weak, it has been found that this increased impact causes greater breakage and wear of the needle hook.

Prior attempts to reduce needle wear and breakage have included modification of the cam track itself. Since the momentum of the needle increases as it is reciprocated at higher speeds, closed cams have been developed having wave-like needle guiding grooves. However, these closed cams have a fixed groove size. Also, modern cams have tracks which have angles of inclination that vary from point to point. Because of these variations, it has been found that the edges of the needle butt may not contact the edges of the cam track smoothly, which is another source of vibration and wear of the needle. In the past, this problem has been partially ameliorated by beveling the corners of the needle butt. However, this measure has not met with the desired success because the relatively small beveled surfaces at the corners of the butt do not provide a large contact area and generally do not conform to the inclination angle of the cam track. As a result, significant butt wear and vibration may still result when the butt impacts the cam track. Additionally, the beveled corners do not permit smooth sliding of the needle butt along the cam track.

It is sometimes desirable to use needles of different gauges in a machine. For example, a 28 gauge needle may have a thickness of about 0.42 mm, whereas an 18 gauge needle may be about 0.65 mm thick. Thus, the difference in thickness between a 28 gauge and an 18 gauge needle is 0.23 mm. If the same cam is used with an 18 gauge or 18 gauge needle, the clearance between the needle butt and cam track may vary according to the thickness of the needle. In the foregoing example, the clearance variation could be as about 0.23 mm if the inclination angle of the cam were about 45°.

It is necessary to insure that the clearance between the cam track and butt is appropriate in order to minimize breakage and wear of the knitting needle due to impact. If the clearance between the cam track and butt is too great, the frequency of needle breakage and the amount of wear of the needle butt are increased. However, if the clearance between the cam track and butt is too small, breakage of the needle butt may result.

Since the clearance between the needle butt and the cam track varies with the needle gauge, it has heretofore sometimes been desirable to change the cam when the gauge of the needles in the machine is changed to insure that the clearance between the needle butt and cam track sidewalls remains appropriate. However, changing the cam is quite expensive. As a result, it is desirable to be able to change the gauge of the knitting needles used in the machine without changing the cam in the machine without encountering the problems associated with improper butt—cam clearance.

In light of the aforementioned deficiencies, it is an object of the present invention to provide a new knitting needle having a butt which permits different gauge needles to be used on a machine having a single size cam track.

Another object of the present invention is to provide a knitting needle for use in knitting machines which has a butt that facilitate smooth sliding of the butt along the sides of the cam track.

Yet another object of the present invention is to provide a knitting needle for use in knitting machines having a butt which mitigates the impact forces between the cam track and needle.

A still further object of the present invention is to provide a knitting needle having a butt which experiences less wear when used in a knitting machine.

A further object of the present invention is to provide a knitting needle having a butt which reduces the wear and breakage of the needle hook associated with use.

Another object of the present invention is to provide a knitting needle having a butt with faces that engage the cam track so as to reduce the amount of vibration within the knitting needle.

SUMMARY OF THE INVENTION

The above and other objects and advantages of the present invention are achieved in the embodiments described herein by the provision of a knitting needle for use in knitting machines that includes a shaft and a butt extending from the shaft for being received within a cam track of a knitting machine. The butt has a pair of substantially parallel side faces aligned with the needle shaft and upper and lower edges extending between the side faces. A medial face extends along a medial portion of each upper and lower edge of the needle butt between the side faces. A pair of angled faces extends between each medial face and side face to interconnect the medial face and side faces. The angled faces have an inclination angle approximately equal to the maximum inclination angle of the cam of the knitting machine in which the knitting needle is used. Each medial face may be arcuate in shape and the angled faces may be tangent to each associated arcuate face. Alternatively, the medial faces may be substantially planar and substantially perpendicular to the side faces of the butt. In a preferred embodiment, each angled face is inclined at an angle of between approximately 40° and 60° In one particularly preferred embodiment, each angled face is inclined at an angle of approximately 55°.

BRIEF DESCRIPTION OF THE DRAWINGS

The foregoing and other objects, advantages and features of the invention, and the manner in which the same are accomplished, will become more readily apparent on consideration of the following detailed description of the invention taken in conjunction with the accompanying drawings which illustrate a preferred and exemplary embodiment, and wherein.

DESCRIPTION OF THE PREFERRED EMBODIMENT

Figure 1:
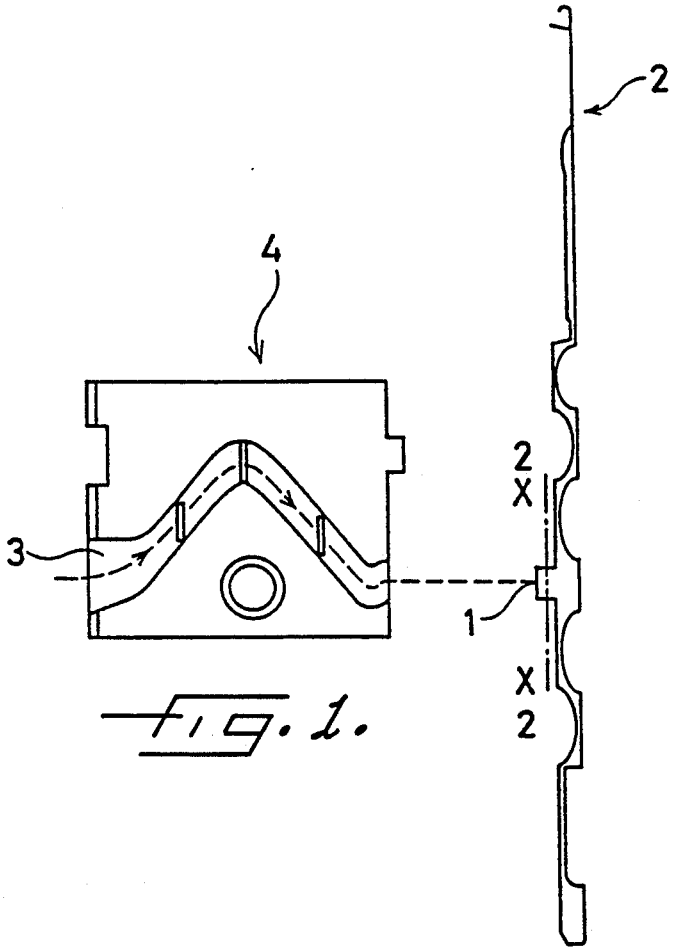
FIG. 1 is a perspective view showing a knitting needle having a butt and a segment of a cam having a track for receiving the needle butt to urge the needle in a reciprocating motion.

Referring now to the drawings FIG. 1 illustrates a knitting needle made in accordance with the present invention, designated generally at 2. The needle 2 includes a butt 1 which extends transverse to the longitudinal shaft of the needle 2. The butt 1 may be attached to the shaft at a variety of locations, including the medial position illustrated in FIG. 1, or at a position closer to one of the ends of the shaft of the needle 2.

As illustrated in FIG. 1, the needle 2 may include a curved hook at one end of its shaft for engaging yarn for knitting. Also shown in FIG. 1 is a latch associated with the hook of the needle 2 which may pivot as the needle 2 is reciprocated for knitting.

FIG. 1 also shows a cam segment designated generally at 4. The cam 4 includes a needle guiding track 3 which defines a recessed slot into which the butt 1 of the needle 2 may be received. In a circular knitting machine, a plurality of cam segments 4 may be affixed adjacent each other to define a continuous, generally undulating path within which the needle butt 1 may pass.

As illustrated in FIG. 1, the needle butt 1 moves through the undulating path defined by the cam track 3. As a result of this relative motion between the cam 4 and the needle butt 1, the needle 2 is urged into reciprocating motion when the sides of the butt 1 contact the sidewalls of the cam track 3.

A plurality of knitting needles 2 may be received within collinear tricks, or slots (not illustrated) which are formed in the knitting machine. These collinear tricks are of an appropriate size and shape to accommodate the shaft of the needle 2, yet are of a depth that will permit the butt 1 of the needle 2 to extend into the cam track 3. As a result, the butts 1 of a plurality of adjacent needles 2 may be received within the recessed cam track 3 such that the needles are urged into reciprocating motion in concert with one another by the relative motion between the needle butt 1 and the cam track 3. Thus, each needle 2 in the machine may be operated in concert with a plurality of other needles installed in the knitting machine to form a knitted fabric.

Figure 2:
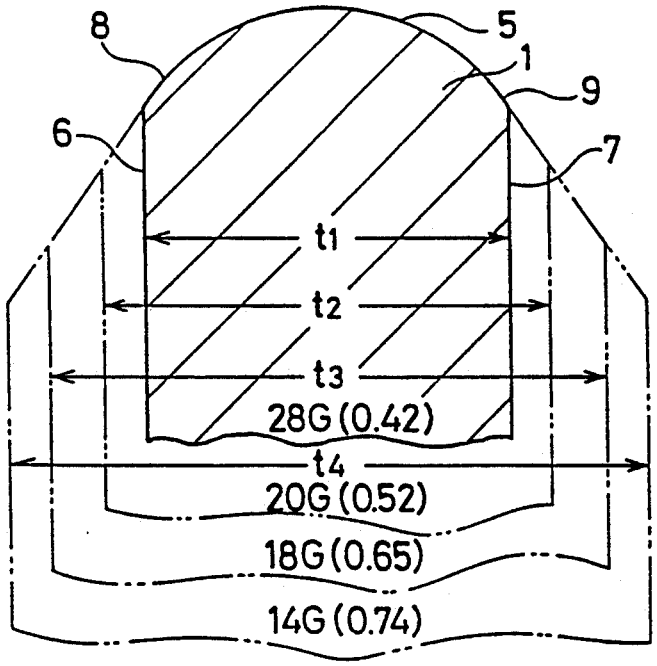
FIG. 2 is a partial cross sectional view taken along line 2—2 of FIG. 1 which illustrates a first preferred embodiment of the invention.

FIG. 2 shows a cross sectional view of a first preferred embodiment of a needle butt 1 made in accordance with the present invention. As indicated in FIG. 2, the gauge or thickness of the needle 2, and consequently the needle butt 1, may vary over a relatively wide range. Exemplary dimensions are shown as t1, t2, t3 and t4, which correspond to the standard 28 gauge, 20 gauge, 18 gauge and 14 gauge needle sizes. As shown in FIG. 2, a standard 28 gauge needle is generally about 0.42 mm wide; a 20 gauge needle is about 0.52 mm wide; an 18 gauge needle is about 0.65 mm wide; and a 14 gauge needle is approximately 0.74 mm wide.

Figure 3:
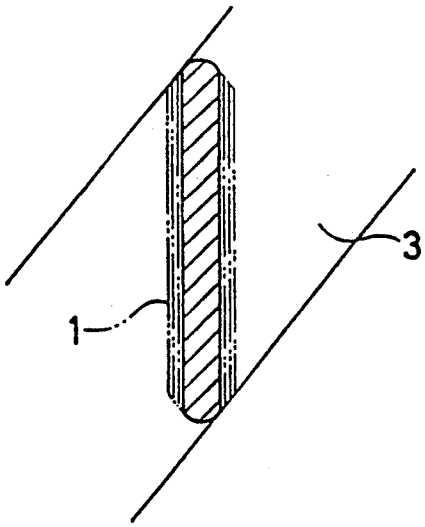
FIG. 3 is a cross sectional environmental view of the needle butt made in accordance with the first preferred embodiment of the invention as it is received within a portion of the cam track.

The embodiment of the needle butt 1 shown in FIG. 2 includes parallel side faces 6 and 7. An arcuate face 5 extends along a medial portion of the upper edge of the needle butt 1 between the side faces 6 and 7. The lower edge of the needle butt 1 may also include a similarly shaped and positioned arcuate face 5, as shown in FIG. 3.

In this first preferred embodiment of the invention, the arcuate face 5 extends only in a medial portion between the side surfaces 6 and 7. Again referring to FIG. 2, angled planar faces 8 and 9 are tangent to the arcuate face 5 and extend outwardly therefrom to join the side faces 6 and 7 of the needle butt 1. It is preferred that these angled tangent faces 8 and 9 extend at an inclination angle that is approximately equal to the maximum inclination angle of the needle guiding track 3 of the cam 4.

Typically, the maximum inclination angle associated with the cam track 3, and consequently, of the tangent faces 8 and 9, may vary between about 40° and 60°, depending on the type of knitting machine in use. In the particularly preferred embodiment shown in FIG. 2, the inclination angle of the faces 8 and 9 is about 55°.

As shown in FIG. 2, the inclination angle of the faces 8 and 9 does not vary if a different gauge needle 2, which therefore has a different width butt 1, is used. The inclined tangent faces 8 and 9 also remain generally planar regardless of differences in needle gauge.

FIG. 3 illustrates the needle butt 1 made in accordance with the first preferred embodiment of the invention, shown in detail in FIG. 2, as it may be received within the cam track 3. As shown in FIG. 3, the inclined faces 8 and 9 of the needle butt 1 may contact the respective sidewalls the cam track 3. Because the faces 8 and 9 are inclined at an angle approximately equal to the maximum inclination angle of the sides of the cam track 3, the needle butt 1 slides smoothly along the cam track 3, regardless of the gauge of the needle 2. Thus, it is seen that needles of varying gauge may be used in association with a single cam 4, since variations in the gauge of the needle 2 do not affect the clearance between the butt 1 and cam track 3, as illustrated by the drawing which illustrates the various gauges of needles illustrated in FIG. 2.

Although the needle butt 1 and cam track 3 shown in FIG. 3 are depicted without any clearance therebetween, it is generally desirable to provide a slight clearance between the butt 1 and the sidewalls of the cam track 3. Of course, the foregoing comments relating to the matching of inclination angle and the angled faces 8 and 9 of the needle butt 1 may also apply to the declining portion of the cam track 3.

Figure 4:
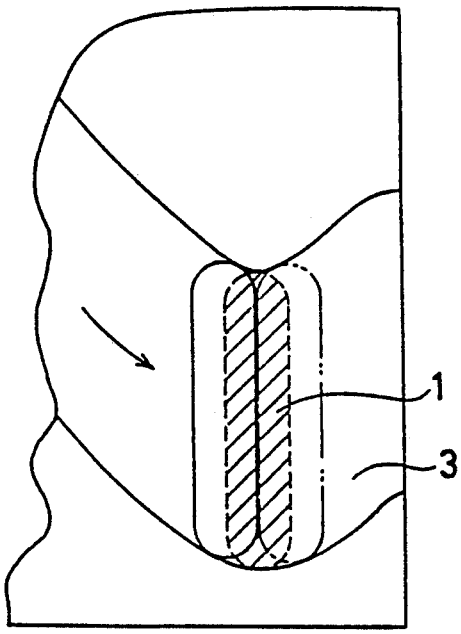
FIG. 4 is another cross sectional environmental view of the needle butt as it is received within another portion of the cam track.

FIG. 4 illustrates the needle butt 1 received within the cam track 3 in the lowermost point on the curve defined by the cam track 3. Because the medial face 5 of the butt 1 is arcuate in shape, uniform surface contact may be maintained with the sidewalls of the cam track 3 as the direction of the needle butt 1 is changed. Thus, the impact caused by inertia forces is mitigated, and a smooth movement of the needle is insured at all times. Additionally, this feature has been found to greatly reduce butt and cam wear because the contact point between the needle butt 1 and the side walls of the needle track 3 constantly changes as the needle butt 1 slides along the turning point of the cam track 3.

Figure 6:
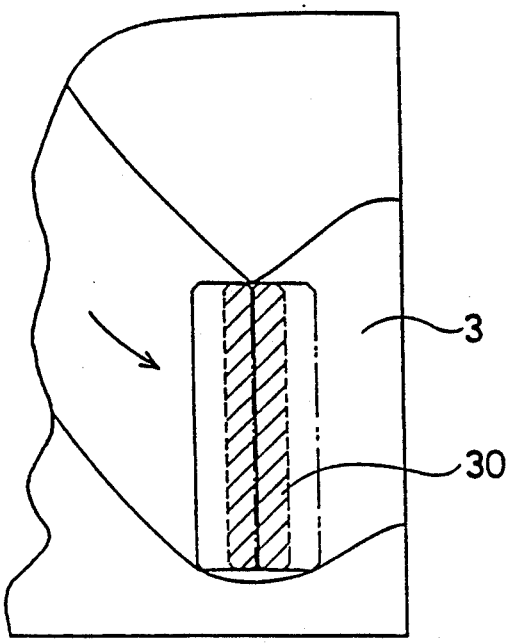
FIG. 6 is an partially cross sectional environmental view of a needle butt made in accordance with the prior art as it is received within a portion of a cam track.

This feature may be compared with needles of the prior art, as shown in FIG. 6. The prior art needle shown therein includes a butt 30, shown in cross section, which has flat upper and lower faces that extend substantially all of the distance between the side faces of the butt 30. The corners of the prior art butt 30 are slightly beveled. The butt 30 as shown in FIG. 6 is received in the cam track 3 at its lowest point. Because the beveling of the corners of the needle butt is minimal, and because the upper and lower surfaces of the needle butt are relatively large and flat, uneven sliding and significant localized wear of the butt 30 typically occurred. Additionally, significant vibration and uneven sliding along the cam track 3 was also associated with the prior art needles having a butt 30.

Figure 5:
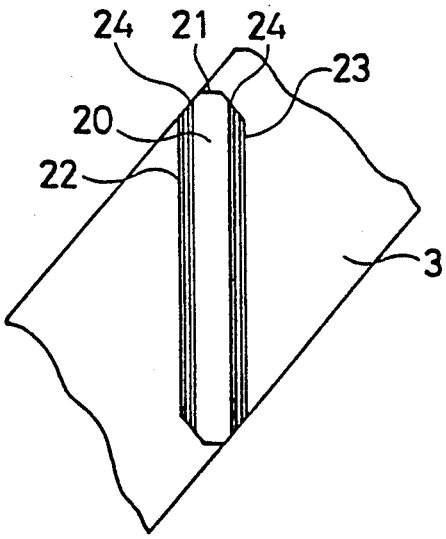
FIG. 5 is a cross sectional environmental view of a second preferred embodiment of a needle having a butt made in accordance with the present invention which shows the butt received within a cam track.

A second preferred embodiment of the invention is illustrated in FIG. 5. This embodiment includes a butt 20 having parallel side faces 22 and 23 oriented in the longitudinal direction of needle 2. The needle butt 20 is shown received within the cam track 3.

The needle butt 20 of this second preferred embodiment of the present invention includes a relatively flat face segment 21 that extends along a medial portion of the upper edge of the butt 20 that between the side faces 22 and 23 of the butt 20. The medial face 21 may be substantially perpendicular to said side faces 22 and 23 of said butt 20. Inclined faces 24 interconnect the medial flat face 21 and the side faces 22 and 23. The lower edge of the butt 20 may also have a similar medial flat face 21 and inclined faces 24.

In this second preferred embodiment, it is also desirable that the inclination angle of the inclined faces 24 be approximately equal to the maximum inclination angle of the needle guiding faces of the cam track 3. The specific angles and characteristics of the angled faces 24 may be similar to the characteristics of the faces 8 and 9 of the first preferred embodiment of the present invention.

In the drawings and specification, there have been disclosed typical preferred embodiments of the invention. Although specific terms have been employed, they have been used in a generic and descriptive sense only and not for purposes of limitation, the scope of the invention being set forth in the following claims.

What is claimed is:

1. A cam and needle system for a circular knitting machine, comprising:

a cam segment having upper and lower sidewalls that define an undulated recessed needle guiding track having a maximum angle of inclination;

a needle having a longitudinal shaft and a needle butt extending transverse to said shaft, said butt being slidably received within said needle guiding track;

said needle shaft and said butt having substantially the same width;

said butt having two side faces substantially parallel to said shaft, two medial faces between said faces and which extend generally transverse to said shaft, and two angled faces extending between said medial face and said side faces;

said angled faces being positioned in close proximity to said sidewalls of said recessed needle guiding track, such that relative motion between said butt and said track causes said angled faces to contact said sidewalls of said track to urge said needle shaft into reciprocating motion; and said angled faces being inclined at approximately said maximum inclination angle of said needle guiding track so that variations in the width of said butt do not substantially alter the proximity between said angled faces and said track sidewalls, whereby needle breakage and wear are minimized and further whereby said angled faces slide smoothly along said track sidewalls.

2. A cam and needle system as defined in claim 1 wherein said angled faces are inclined at between about 40 and 60 degrees.

3. A cam and needle system as defined in claim 2 wherein said angled faces are inclined at about 55 degrees.

4. A cam and needle system as defined in claim 1 wherein said medial faces are arcuate and wherein said angled faces are tangent to said arcuate medial faces.

5. A cam and needle system as defined in claim 1 wherein said medial faces are flat and substantially perpendicular to said longitudinal needle shaft.

6. A cam and needle system for a circular knitting machine, comprising:

a cam segment having upper and lower sidewalls that define an undulating recessed needle guiding track having a maximum angle of inclination;

a needle having a longitudinal shaft and a needle butt extending transverse to said shaft, said butt being slidably received within said needle guiding track;

said needle shaft and said butt having substantially the same width, said width being between about 0.42 mm and 0.74 mm;

said butt having two side faces substantially parallel to said shaft, two medial faces between said side faces and which extend generally transverse to said shaft, and two angled faces extending between each said medial face and said side faces;

said angled faces being positioned in close proximity to said sidewalls of said recessed needle guiding track, such that relative motion between said butt and said track causes said angled faces to contact said sidewalls of said track to urge said needle shaft into reciprocating motion; and said angled faces being inclined at approximately said maximum inclination angle of said needle guiding track so that variations in the width of said butt over said range of widths do not substantially alter the proximity between said angled faces and said track sidewalls, whereby needle breakage and wear are minimized and further whereby said angled faces slide smoothly along said track sidewalls.

7. A cam and needle system as defined in claim 6 wherein said angled faces are inclined at between about 40 and 60 degrees.

8. A cam and needle system as defined in claim 7 wherein said angled faces are inclined at about 55 degrees.

9. A cam and needle system as defined in claim 6 wherein said medial faces are arcuate and wherein said angled faces are tangent to said arcuate medial faces.

10. A cam and needle system as defined in claim 6 wherein said medial faces are flat and substantially perpendicular to said longitudnal needle shaft.

11. A cam and needle system for a circular knitting machine, comprising:

at least one cam segment having upper and lower sidewalls that define a recessed needle guiding track having a maximum angle of inclination of between about 40 degrees and 60 degrees;

at least one knitting needle having a longitudinal shaft and a needle butt extending transverse to said shaft, said butt being slidably received within said needle guiding track;

said needle shaft and said butt being substantially identical in width, said width being between 14 and 28 gauge;

said butt having two side faces substantially parallel to said shaft, two arcuate faces intermediate said side faces and extending generally transverse to said shaft, and two angled faces tangent each said arcuate face, said angled faces extending between said arcuate faces and said side faces, said butt defined by said side faces, arcuate faces and angled faces having a substantially axially symmetrical shape relative to said longitudinal shaft;

said angled faces being positioned in close proximity to said sidewalls of said recessed needle guiding track, such that relative motion between said butt and said track causes said angled faces to contact said sidewalls of said track to urge said needle shaft into reciprocating motion; and said angled faces being inclined at approximately said maximum inclination angle of said needle guiding track so that variations in the gauge of said butt over said range do not substantially alter the proximity between said angled faces and said track sidewalls, whereby said needle breakage and wear are minimized and further whereby said angled faces slide smoothly along said track sidewalls.

12. A cam and needle system as defined in claim 11 wherein said maximum inclination angle is about 55 degrees.

13. A cam and needle system for a circular knitting machine, comprising:

at least one cam segment having upper and lower sidewalls that define a recessed needle guiding track having a maximum angle of inclination of between about 40 degrees and 60 degrees;

at least one knitting needle having a longitudinal shaft and a needle butt extending transverse to said shaft, said butt being slidably received within said needle guiding track;

said needle shaft and said butt being substantially identical in width, said widths being between 14 and 28 gauge;

said butt having two side faces substantially parallel to said shaft, two flat faces substantially perpendicular to said shaft extending intermediate said side faces and generally transverse to said shaft, and two angled faces extending between each said flat face and said side faces, said butt defined by said side faces, flat faces and angled faces having a substantially axially symmetrical shape relative to said longitudinal shaft;

said angled faces being positioned in close proximity to said sidewalls of said recessed needle guiding track, such that relative motion between said butt and said track causes said angled faces to contact said sidewalls of said track to urge said needle shaft into reciprocating motion;

said angled faces being inclined at approximately said maximum inclination angle of said needle guiding track so that variations in the gauge of said butt over said range do not substantially alter the proximity between said angled faces and said track sidewalls, whereby needle breakage and wear are minimized and further whereby said angled faces slide smoothly along said track sidewalls.

14. A cam and needle system as defined in claim 13 wherein said maximum inclination angle is about 55 degrees.

* * * * *

UNITED STATES PATENT AND TRADEMARK OFFICE
CERTIFICATE OF CORRECTION

PATENT NO. : 5,327,748

DATED : July 12, 1994

INVENTOR(S) : Izumi, et al.

It is certified that error appears in the above-identified patent and that said Letters Patent is hereby corrected as shown below:

On the title page, item [54] and col. 1, line 1, in the title:

Delete "Knitting Needle for Knitting Machines" and insert -- Cam and Needle System for a Circular Knitting Machine --.

Signed and Sealed this

First Day of November, 1994

*Attest:*

*Attesting Officer*

Bruce Lehman

BRUCE LEHMAN

*Commissioner of Patents and Trademarks*